US009233404B1

(12) United States Patent
Munoz et al.

(10) Patent No.: US 9,233,404 B1
(45) Date of Patent: Jan. 12, 2016

(54) FLUID PULSE GENERATOR FOR CLEANING PASSAGEWAYS

(71) Applicants: Robert J. Munoz, Elk Grove, CA (US); Karl T. Matis, Cumming, GA (US); Matthew D. Sibilio, Cumming, GA (US)

(72) Inventors: Robert J. Munoz, Elk Grove, CA (US); Karl T. Matis, Cumming, GA (US); Matthew D. Sibilio, Cumming, GA (US)

( * ) Notice: Subject to any disclaimer, the term of this patent is extended or adjusted under 35 U.S.C. 154(b) by 165 days.

(21) Appl. No.: 14/158,001

(22) Filed: Jan. 17, 2014

(51) Int. Cl.
*B01F 3/04* (2006.01)
*B08B 9/032* (2006.01)

(52) U.S. Cl.
CPC ..... *B08B 9/0326* (2013.01); *B01F 3/04007* (2013.01); *B01F 3/04985* (2013.01)

(58) Field of Classification Search
CPC ..... B01F 3/04007; B01F 3/04985
USPC ..... 261/76, 77, 119.1, DIG. 54
See application file for complete search history.

(56) References Cited

U.S. PATENT DOCUMENTS 3,997,631 A * 12/1976 Matsuoka ..... B01F 3/04985 210/192
5,615,695 A 4/1997 Chambers
2001/0054655 A1* 12/2001 Berg ..... B60S 1/481 239/284.1

FOREIGN PATENT DOCUMENTS

JP 55155229 A * 12/1980

* cited by examiner

*Primary Examiner* — Robert A Hopkins
(74) *Attorney, Agent, or Firm* — Theodore J. Bielen, Jr.

(57) ABSTRACT

The apparatus for producing a pulsing flow of fluids to a fluid line including a housing having first, second and third passages. The first passage communicates with a source of compressed gas and a first conduit, communicating with a solvent liquid source, and passes through the housing. A narrowed transverse dimension between the conduit and the inner chamber of the housing creates a pulsing delivery of fluids from the gas and liquid sources.

11 Claims, 4 Drawing Sheets

FLUID PULSE GENERATOR FOR CLEANING PASSAGEWAYS

BACKGROUND OF THE INVENTION

The present invention relates to a novel and useful apparatus for producing a pulsing flow of fluid to a fluid line from compressed air and liquid sources.

Heat exchangers include conduits along parallel paths that are widely employed for carrying cooling and heating fluids in the automotive, aviation, and marine systems. For example, such devices may include condensers, automatic transmission air coolers, engine oil air coolers, fuel coolers, heater cores, radiators, and air conditioning evaporators, and the like.

A problem exists with such heat exchangers in that they become partially or completely clogged and contaminated over time due to deposits of materials from the cooling fluids. The problem of contamination has often been extensive enough to require removal and replacement of heat exchanger equipment.

In the past, many of the methods for cleaning and unclogging fluid circuits, using strictly chemical means, has proven to be time consuming, ineffective, incomplete, and expensive. Also, the problem of collection and recovery of used cleaning fluids poses an environmental hazard and entails further expense.

In the past, a novel system for cleaning heat exchanger circuits was proposed in the U.S. Pat. No. 5,615,695. Although successful to a large degree, the system described in U.S. Pat. No. 5,615,695 is bulky and has a structure that makes it difficult to control of the flow of air at the air entry portion of such a system.

An efficient and compact apparatus for the production of a pulsing flow of liquid in order to clean a heat exchanger would be a notable advance in the mechanical arts.

SUMMARY OF THE INVENTION

In accordance with the present invention, an apparatus for producing a pulsing flow of fluids from a fluid source is herein provided.

The device of the present invention utilizes a housing which possesses an inner chamber having a certain transverse dimension. First, second, and third passages communicate with the chamber of the housing. The first passage to the inner chamber of the housing communicates with a source of compressed air. A second passage to the inner chamber of the housing communicates with the source of liquid in the form of a cleaning solvent.

A first conduit extends through the second passage to the liquid source. The first conduit also extends through the inner chamber to the third passage communicating with the housing inner chamber. A space or gap between the first conduit and the wall of the third passage is formed in the housing. In certain cases, another gap is formed between the wall of the second passage and the first conduit.

A second conduit connects the output of the third passage in the form of a fluid line that extends to the system being flushed by the apparatus of the present invention.

In certain cases, the first conduit may lie along or in relation to an axis that generally coincides or lies relative to the axis of the second and third passages. In addition, the inner surface of the housing at the third passage may be a curved surface and the outer surface of the first conduit may be a curved surface, as well. This relationship results in an annular space between the first conduit and the housing at the third passage. In addition, the second passage may include a nipple connected to the housing and supporting the first conduit at the second passage.

As heretofore stated, the nipple connected to the housing of the second passage can form a gap between the aperture of the nipple and the first conduit passing through the nipple. This apparatus is typically employed with the embodiment of the invention where the liquid source is in a liquid container, rather than an external pressurized liquid supply, such as municipal water source, and the like.

It may be apparent that a novel and useful apparatus for producing a pulsing flow of fluids to a fluid line for cleaning heat exchanges and the like has been above described.

It is therefore an object of the present invention to provide an apparatus for producing a pulsing flow of fluids to a fluid line that is capable of cleaning heat exchanger circuits to avoid replacement of the heat exchanger itself.

Another object of the present invention is to provide an apparatus for producing a pulsing flow of fluids to a fluid line that is capable of cleaning heat exchangers having parallel circuits.

A further object of the present invention is to provide an apparatus for producing a pulsing flow of fluids to a fluid line which supplies a high kinetic energy pulse of cleaning liquid and air which flushes heat exchanger systems.

Another object of the present invention is to provide an apparatus for producing a pulsing flow of fluids to a fluid line for cleaning conduits that is amenable to collection of contaminated cleaning fluids for reuse or disposal in a simple manner.

A further object of the present invention is to provide an apparatus for producing a pulsing flow of fluids to a fluid line that is capable of accommodating various cleaning liquids such as water, oils, petroleum distillates and the likes.

A further object of the present invention is to provide an apparatus for producing a pulsing flow of fluids to a fluid line in which the frequency of the pulses is easily adjusted and accurately maintained throughout the cleaning cycle.

Yet another object of the present invention is to provide an apparatus for producing a pulsing of fluids to a fluid line for cleaning heat exchangers and the like that is compact and affordable.

The invention possesses other objects and advantages especially as concerns particular characteristics and features thereof which will become apparent as the specification continues.

Figure 1:
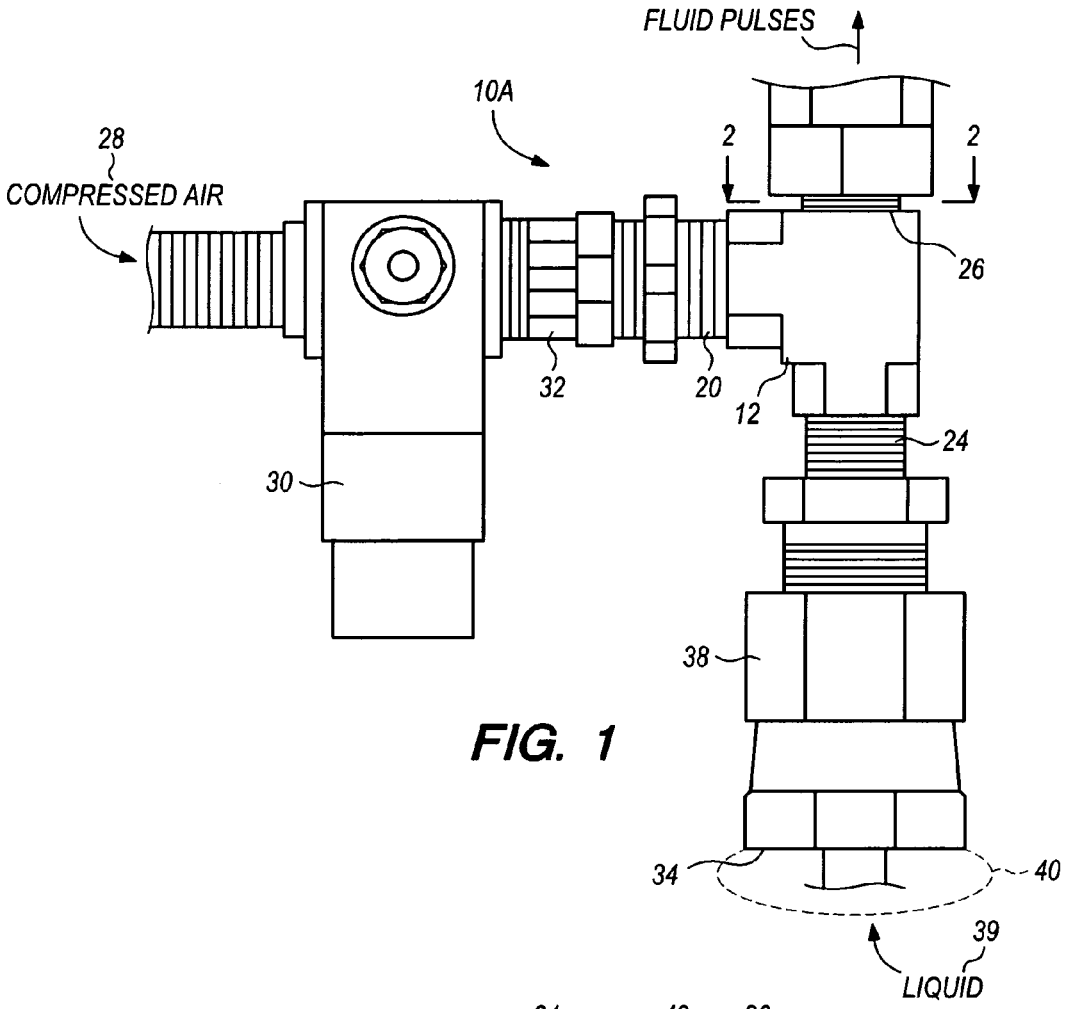
FIG. 1 is a side elevational view of the apparatus of the present invention.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

An embodiment of the invention as a whole is shown in the drawings by reference character 10, followed by an upper case letter to denote multiple embodiments.

Figure 2:
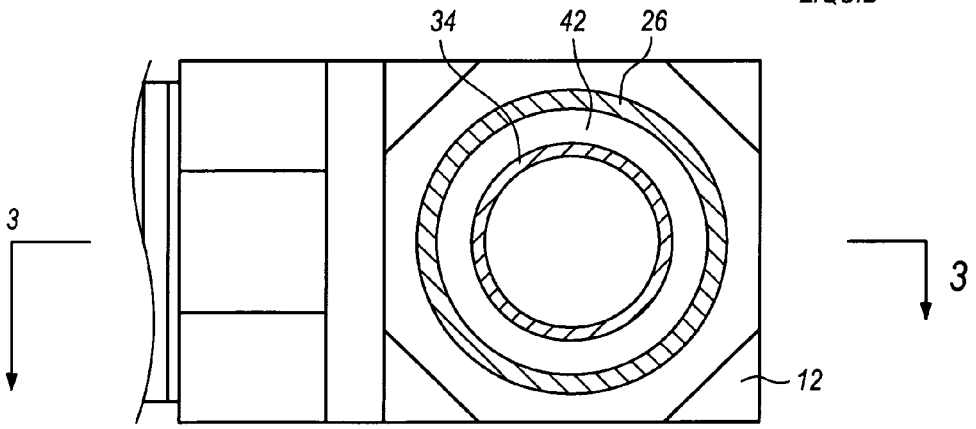
FIG. 2 is a partial sectional view taken along line 2-2 of FIG. 1.
Figure 3:
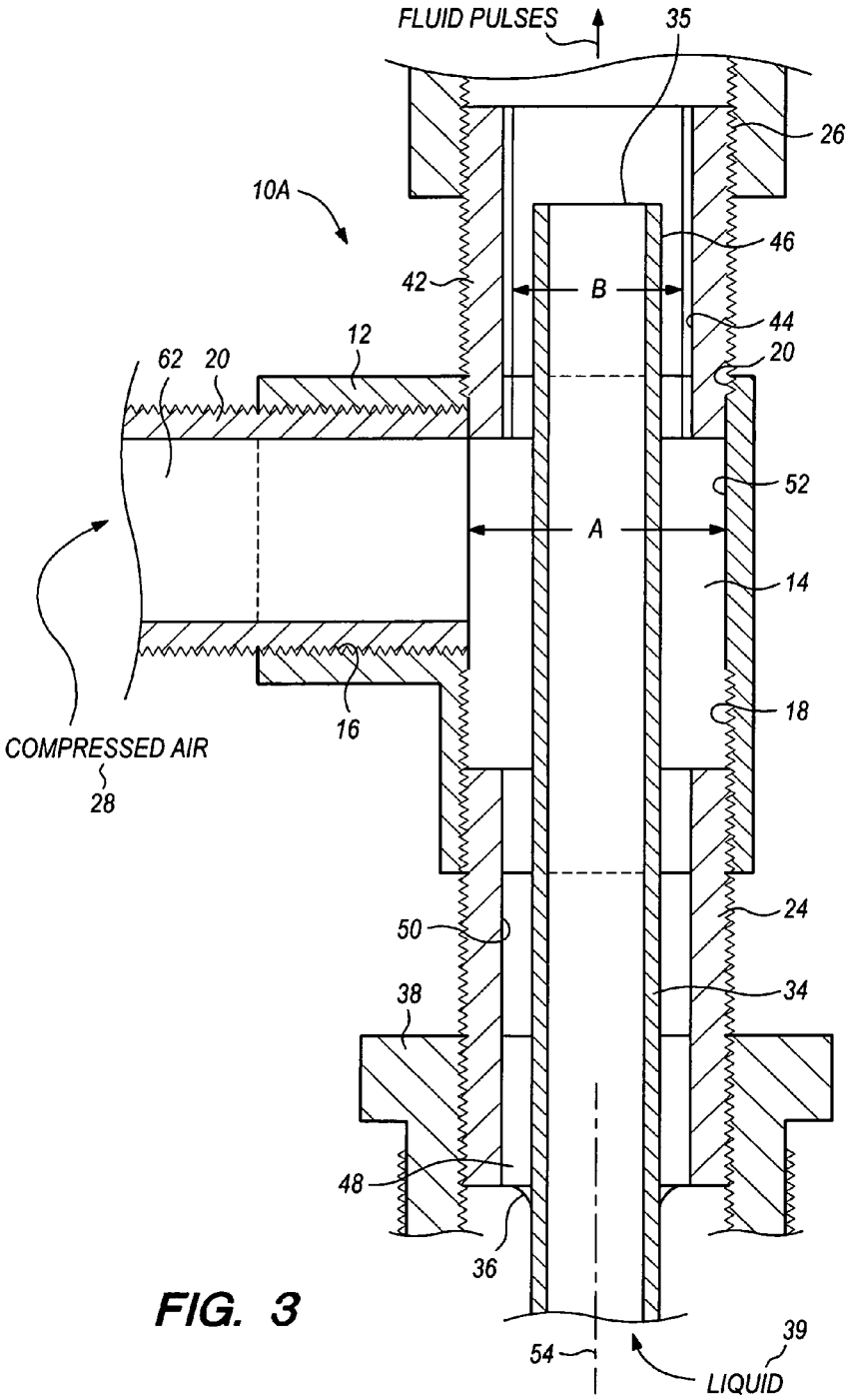
FIG. 3 is a sectional view taken along line 3-3 of FIG. 2.

The apparatus of the present invention 10A is depicted in FIGS. 1, 2, and 3 and includes as one of its elements a housing 12. Housing 12 includes an inner chamber 14 having a transverse dimension "A". First passage 16, second passage 18, and third passage 20 lead to inner chamber 14 such that housing 12 is generally tee-shaped. Threaded nipples 22, 24, and 26 threadingly engage first, second, and third passages 16, 18, and 20, respectively.

With further reference to FIGS. 1, 2, and 3, it may observed that first passage 16 communicates with a source of compressed air or gas 28. Air pressure regulator 30 and check valve 32 may be employed with the delivery of compressed air 28 to first passage 16. For example, compressed air source 28 may range from 30-60 PSI.

It should noted that the internal transverse dimension or diameter of threaded nipple 28 "B" is less than the transverse dimension "A" of interior chamber 14, FIG. 3.

A conduit 34 extends through nipple 24, housing 12, and to a place within nipple 26. Conduit 34 may be formed of any suitable material, such as metal, plastic, and the like. Weld portion 36 indicates that conduit 34 is held to nipple 24 that is surrounded by fitting 38 intended to connect to a solvent liquid 39 filling tank 40, FIG. 5. It should be noted that a space or gap 42 exists between the exterior of conduit 34 and the inner wall 44 of threaded nipple 26. It should also be noted that the outer surface of conduit 34 and the inner surface 44 of nipple 26 are curved such that gap 42 is an annular space. Also, end 35 of conduit 34 may be positioned within nipple 26, as desired.

In addition, in embodiment 10A shown in FIGS. 1 and 3, a gap or annular space 48 is formed between the outer surface 46 of conduit 34 and the curved inner surface 50 of nipple 24. Moreover, the inner surface 52 of chamber 14 is generally curved and lies along an axis 54. Curved cylindrical nipples 24 and 26 are oriented in FIG. 3 to also lie along or relative to axis 54.

Figure 4:
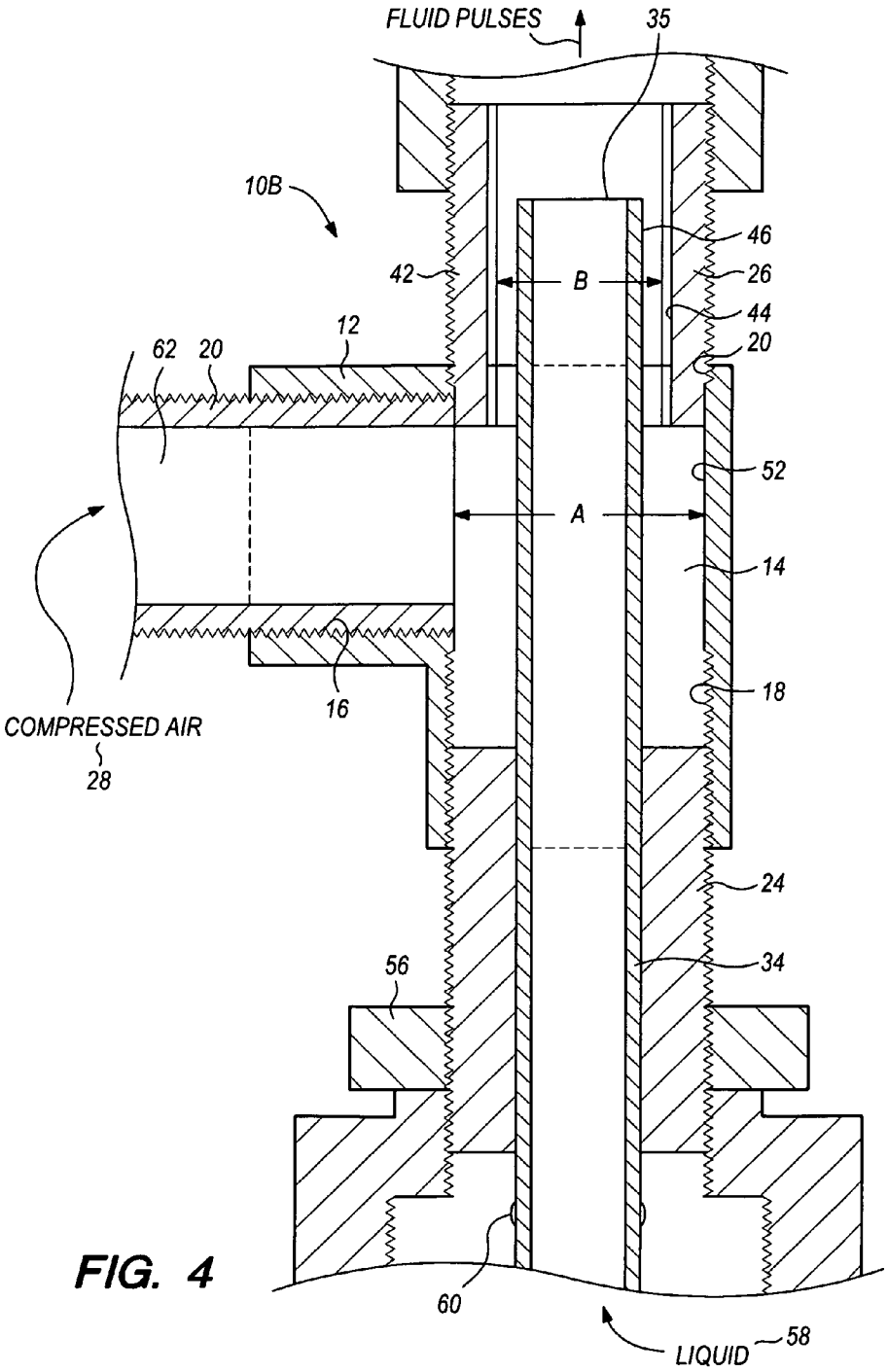
FIG. 4 is a sectional view similar to FIG. 3, showing another embodiment of the present invention.

Turning now to FIG. 4, it may be seen that another embodiment 10B of the apparatus of the present invention is shown. Apparatus 10B includes housing 14 having passageways 16, 18, and 20. However, no gap exists between conduit 34 and threaded nipple 24 in second passageway 18. Pressure fitting 56 connects conduit 34 to a source of liquid pressure 58, such as a municipal water supply. Conduit 34 may then be brazed to fitting 56, indicated by solder line 60.

Figure 5:
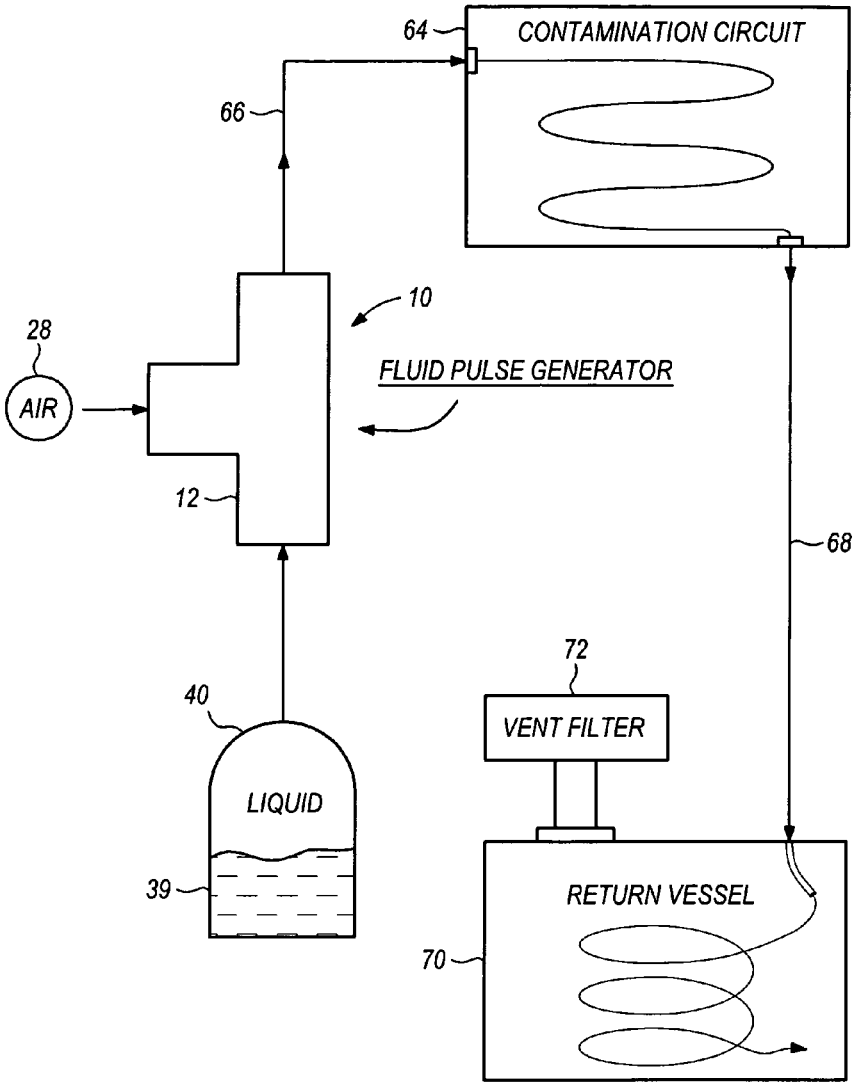
FIG. 5 is a schematic view showing the overall operation of the apparatus of the present invention in cleaning a contamination circuit, such as a heat exchanger.

In operation, FIGS. 3, 4, and 5, device 10A is connected to a source of solvent liquid which may be a liquid 39 in tank 40 or a pressurized liquid supply 58, such as a municipal water source. Conduit 34 extends into tank 40 in embodiment 10A. FIG. 5 indicates the liquid solvent in a tank 40. Compressed gas or air 28 is also applied to housing 12 from a compressed gas supply such that gas passes through first passageway 16, specifically the interior opening 62 through threaded nipple 20. The compressed gas flowing from compressed gas source 28 then enters chamber 14 of housing 12 such that compressed gas travels through gap 42 between the outer surface 44 and conduit 34 and the inner surface 42 of nipple 26, the upstream air passage. Simultaneously, gas in embodiment 10A, enters gap 48 between the outer surface 46 of conduit 34 and the inner surface 50 of nipple 24. Such gas 46 passage, the downstream branch, increases the air pressure in cleaning liquid tank 40, which forces the cleaning liquid 39 through conduit 34. Of course, since gap or annular space 48 does not exist in embodiment 10B, liquid 58 is already pressurized from a liquid pressure source.

It may be understood that the source of liquid 39 or 58 may take the form of various solvents intended to clean contamination circuit 64, which is typically a heat exchanger having generally parallel tubes. Such solvents may take the form of water, mineral spirits, light petroleum distillates, kerosene, citrus based oils, terpene, turpentine, and the like.

Most importantly, compressed gas flowing through first passageway 16, chamber 14, and third passageway 26 recognizes the restricted transverse dimension of threaded nipple 26, dimension "B", relative to the relatively large dimension across chamber 14, dimension "A". Such difference in dimensions increases the velocity of compressed air flowing through housing 14 and out third passageway 20, specifically the interior annular space 42 found within threaded nipple 26. A venturi action, thus, occurs and increases the flow of cleaning liquid 39 from tank 40, embodiment 10A, or from a pressurized source 58, embodiment 10B. The liquid 39 is then accelerated through conduit 34 and out the end of conduit 34 by the relatively high velocity of the air passing through gap 42. A small reduction in air pressure then occurs at the downstream area of device 10A which interrupts the flow of liquids up conduit 34 in an intermittent fashion. After such interruption of liquid flow, the liquid pressure again builds through conduit 34. Such rising and falling of pressure of liquids from conduit 34 results in a moving pulse of liquid and air being formed at third portion of housing 14. In embodiment 10B such pulses are created by the venturi action in the upstream section of housing 12, specifically at gap 42. The frequency of such pulses may range between 3-6 per second. In other words, the continuous raising and falling of liquid pressure causes a rapid pulsing action at the outlet of housing 14 at third passage 20, directing solvent liquid and gas fluids from which is directed to a second conduit or discharge hose 66, FIG. 5. Such pulsing action of fluids increases the ability of apparatus 10A or 10B to dislodge, scrub, and remove particles in contamination circuit 64, FIG. 5, that are not removed by prior art constant flow of cleaning fluid.

The actual size and dimension of the components of apparatuses 10A or 10B may be varied according to the amount of liquid pressure, the size of the tank 40, and the size of gaps 42 in apparatus 10A or 10B and the size of gap 48 around conduit 34 at the upstream and downstream ends of apparatus 10A. Also, the position of the end 35 of first conduit 34 within threaded nipple 26 may be adjusted to effect fluid pulsation. Such dimension may be also varied according to the liquid viscosity of the fluids coming from solvent liquid source 39 or 58.

FIG. 5 also indicates that following cleaning of contamination circuit 64, a return hose 68 recovers the fluid from contaminated circuit 64 and directs the same to a return vessel 70 which may include a vent filter 72. The return hose 68 may be directed to return vessel 70 so that the flow of recovered fluid travels around the inside of return vessel 70 in a spiral path to minimize splash. Such spiral action creates a condensing effect as liquid drops to the bottom of container vessel 70 while air passes through air vent 72.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus for producing a pulsed flow of fluid to a fluid line from a liquid source through a conduit, utilizing compressed gas from a compressed gas source,
comprising:

a) a housing, said housing, possessing an inner chamber having a certain traverse dimension and first, second, and third passages communicating with said housing to said inner chambers, said first passage communicating with the source of compressed gas, said third passage having a transverse dimension less than said certain transverse dimension of said inner chamber;

b) a first conduit, said first conduit communicating with said liquid source, extending to said second passage, to said inner chamber of said housing and to said third passage communicating with said housing inner chambers, said third passage forming a space substantially surrounding said first conduit and said housing, and c) a second conduit, said second conduit connecting said third passage with the fluid line.

2. The apparatus of claim 1 in which said inner chamber of said housing lies along an axis and said second passage and third passage each lie along said axis.

3. The apparatus of claim 2 in which said first conduit lies along said axis.

4. The apparatus of claim 1 in which said first conduit includes a curved outer surface and said third passage is formed by a curved inner surface of said housing and said third passage generates an annular space substantially surrounding said first conduit.

5. The apparatus of claim 1 in which further comprises a nipple linked to said housing at said second passage, said nipple supporting said first conduit.

6. The apparatus of claim 1 which additionally comprises a nipple connected to said housing at said second passage said nipple including an aperture therethrough said first conduit extending through said aperture through said nipple, said nipple forming a gap surrounding said first conduit.

7. The apparatus of claim 6 in which said inner chamber of said housing lies along an axis and said second passage and third passage each lie along said axis.

8. The apparatus of claim 7 in which said first conduit lies along said axis.

9. The apparatus of claim 6 in which said first conduit includes a curved outer surface and said third passage is formed by a curved inner surface of said housing and said third passage generates an annular space substantially surrounding said first conduit.

10. The apparatus of claim 6 in which said nipple supports said first conduit.

11. The apparatus of claim 1 in which said first conduit includes an end, said end of said first conduit being selectively positioned within said third passage of said housing.

* * * * *